US011672339B2

(12) United States Patent
Crowe et al.

(10) Patent No.: US 11,672,339 B2
(45) Date of Patent: Jun. 13, 2023

(54) FURNITURE GLIDES

(71) Applicant: FCC Commercial Furniture, Inc., Roseburg, OR (US)

(72) Inventors: Scott Douglas Crowe, Roseburg, OR (US); Matthew Joshua Brooks, Roseburg, OR (US)

(73) Assignee: FCC Commercial Furniture, Inc., Roseburg, OR (US)

( * ) Notice: Subject to any disclaimer, the term of this patent is extended or adjusted under 35 U.S.C. 154(b) by 49 days.

(21) Appl. No.: 17/488,795

(22) Filed: Sep. 29, 2021

(65) Prior Publication Data

US 2022/0110448 A1 Apr. 14, 2022

Related U.S. Application Data

(60) Provisional application No. 63/091,179, filed on Oct. 13, 2020.

(51) Int. Cl.
*A47B 91/06* (2006.01)

(52) U.S. Cl.
CPC ..... *A47B 91/06* (2013.01)

(58) Field of Classification Search
CPC ..... A47B 91/06
See application file for complete search history.

(56) References Cited

U.S. PATENT DOCUMENTS 2,633,599 A * 4/1953 Dolan ..... A47B 91/06 135/77
2,875,552 A * 3/1959 Stillman ..... A47B 91/04 248/363
3,021,551 A * 2/1962 Kramcsak, Jr. ..... A47B 91/06 16/42 T
3,025,105 A * 3/1962 Nash ..... A47C 3/04 297/DIG. 2
3,080,601 A * 3/1963 Kramcsak, Jr. ..... A47B 91/06 248/188.8
3,191,212 A * 6/1965 Hahn ..... A47B 91/066 16/42 R
3,191,213 A * 6/1965 Congdon ..... A47B 91/066 16/42 T
3,389,421 A * 6/1968 Wheeler ..... A47B 91/16 16/42 R
3,505,724 A * 4/1970 Karl ..... A47B 91/06 29/469
4,460,298 A * 7/1984 Solarz ..... F16B 37/043 411/908

(Continued)

FOREIGN PATENT DOCUMENTS

EP 3818908 A1 * 5/2021 ..... A47B 91/066

*Primary Examiner* — Jason W San
(74) *Attorney, Agent, or Firm* — Chernoff, Vilhauer, McClung & Stenzel, LLP

(57) ABSTRACT

A glide assembly that can be selectively inserted into a variety of furniture items, including chairs, to protect the user from undesirable sound and vibration upon movement, and to protect the floor surface in contact with the furniture item. In some embodiments, the glide may include a surface floor contact member and a dampener isolator made from materials with noise and vibration reduction characteristics. Each of the components may further include ribbed members to facilitate attachment to the furniture leg. Each of the glide components may further include flanges on an end so that components are not lost upon insertion.

20 Claims, 3 Drawing Sheets

(56) References Cited

U.S. PATENT DOCUMENTS 5,170,972 A * 12/1992 Casals Guell ..... A47B 91/04 16/42 T
5,191,676 A * 3/1993 Gerner ..... A47B 91/06 16/42 T
5,287,595 A * 2/1994 Stevens, Jr. ..... B60B 33/0002 16/42 T
5,881,979 A * 3/1999 Rozier, Jr. ..... A47B 91/024 248/188.4
5,881,980 A * 3/1999 Knudson ..... A47B 9/00 16/39
6,883,530 B2 * 4/2005 Kawakami ..... A61H 3/0288 135/84
7,290,741 B1 * 11/2007 Cox ..... A47B 91/06 248/188.4
7,762,506 B2 * 7/2010 Beshore ..... A47C 7/002 411/510
8,037,574 B2 * 10/2011 Chase ..... A47B 91/06 16/42 T
8,230,552 B2 * 7/2012 Klugh ..... A61H 3/0288 16/24
2006/0053586 A1 * 3/2006 Chase ..... A47C 7/002 16/42 R
2006/0054755 A1 * 3/2006 Hornberger ..... A47C 5/04 248/188.9
2007/0089266 A1 * 4/2007 Beshore ..... A47C 7/002 16/42 R
2008/0086845 A1 * 4/2008 Gianandrea ..... A47B 91/06 16/42 R
2008/0178430 A1 * 7/2008 Berthiaume ..... A47C 7/002 16/42 T
2008/0244870 A1 * 10/2008 Chase ..... A47B 91/06 16/42 R
2009/0025184 A1 * 1/2009 Clarke ..... A47B 91/066 16/42 T
2010/0229346 A1 * 9/2010 Chiu ..... A61H 3/0288 16/42 T
2011/0198458 A1 * 8/2011 Karl ..... A47C 7/002 248/188.4
2012/0174340 A1 * 7/2012 Wagner ..... A47C 7/002 16/42 T
2012/0240355 A1 * 9/2012 Chase ..... A47B 91/06 16/42 T
2013/0061894 A1 * 3/2013 Liu ..... A45B 9/04 16/42 T
2013/0117965 A1 * 5/2013 Sievers ..... A47B 91/06 16/18 R
2013/0161456 A1 * 6/2013 Adams ..... A47B 91/12 248/188.9
2018/0038598 A1 * 2/2018 Tonietto ..... F16L 59/02
2022/0225768 A1 * 7/2022 Newman ..... A47B 91/12

* cited by examiner

FURNITURE GLIDES

CROSS-REFERENCE TO RELATED APPLICATIONS

This application claims benefit of U.S. Provisional Application Ser. No. 63/091,179, which was filed on Oct. 13, 2020 and entitled "Furniture Glide Assembly." The complete disclosure of the above application is hereby incorporated by reference for all purposes.

BACKGROUND OF THE INVENTION

The present invention is directed to furniture leg glides or gliders, and more specifically to a glider that removably attaches to metal furniture legs.

It is generally known that furniture items of a substantial weight and can cause considerable noise when a user moves or shifts the furniture item across the floor surface. On the flipside however, furniture that is lighter in weight tends to be moved around more by a user, and as such has the tendency to generate more sound in the process. Aside from the noise generated from the floor surface upon contact with the furniture item, vibrations generated from the furniture piece itself in the process of moving can also cause discomfort to the user or create additional sound. The latter can occur if the furniture item, such as a chair, lacks an effective resilient member on its legs to reduce vibration. In addition, in the process of moving, depending on the material of the leg of the furniture or the material of the floor, the leg can also cause damage to the floor when the furniture leg is in direct contact with the floor surface. Such damage is often undesirable for aesthetic purposes, as well as from a functional standpoint, because it creates permanent damage to the flooring, which can be expensive to repair.

To combat unwanted noise and friction, oftentimes a user may simply place an intermediate surface, such as a rug or some other cover, between the furniture item and the floor surface to reduce friction and minimize or muffle the effect. However, the effectiveness of this method would depend on the selection of the intermediate surface, and the furniture piece would be limited to placement on the intermediate surface.

In other instances, furniture glides may be attached onto furniture legs. Notably, the current furniture glides serve primarily to reduce damage and are not designed in mind to effectively reduce both the aforementioned noise or vibration that occurs in use. Many of these existing glides come in the form of nails or adhesives to attach to the furniture piece itself, or a simple sleeve that encases or encloses the furniture leg. For those that boast noise-reduction properties, the glides are wholly composed from noise-reduction material, where the material is then directly assembled onto the leg and is in direct contact with the floor surface. Oftentimes, the material used for noise-reduction is softer, prone to damage, and not suitable for long-term use. In sum, the glides do not reduce vibration.

Further, while these glides may help reduce noise to some extent, oftentimes the glide is not a good fit with the dimensions of the leg, and as such may easily detach from the leg and become lost with use. Adhesives may lose effectiveness over time. For glides that use nails or screws to attach to the furniture, the furniture leg can become damaged simply after one-time use, or the glide may become prone to dislocating after repeated use by the nail or screw. In other cases, the leg may provide noise reduction but does not prevent vibration or damage, or vice versa.

What is desired, therefore, is a furniture glide that can be removably attached to a furniture leg, where the glide is sufficiently durable with use, can stay in place and attached with the furniture leg for a prolonged period of time without damaging the leg or the glide itself, and at the same time effectively reduce noise and vibration to a user, and minimize damage to the flooring.

BRIEF DESCRIPTION OF THE SEVERAL DRAWINGS

For a better understanding of the invention, and to show how the same may be carried into effect, reference will now be made, by way of example to the accompanying drawings, which:

DETAILED DESCRIPTION OF PREFERRED EMBODIMENTS

Figure 1:
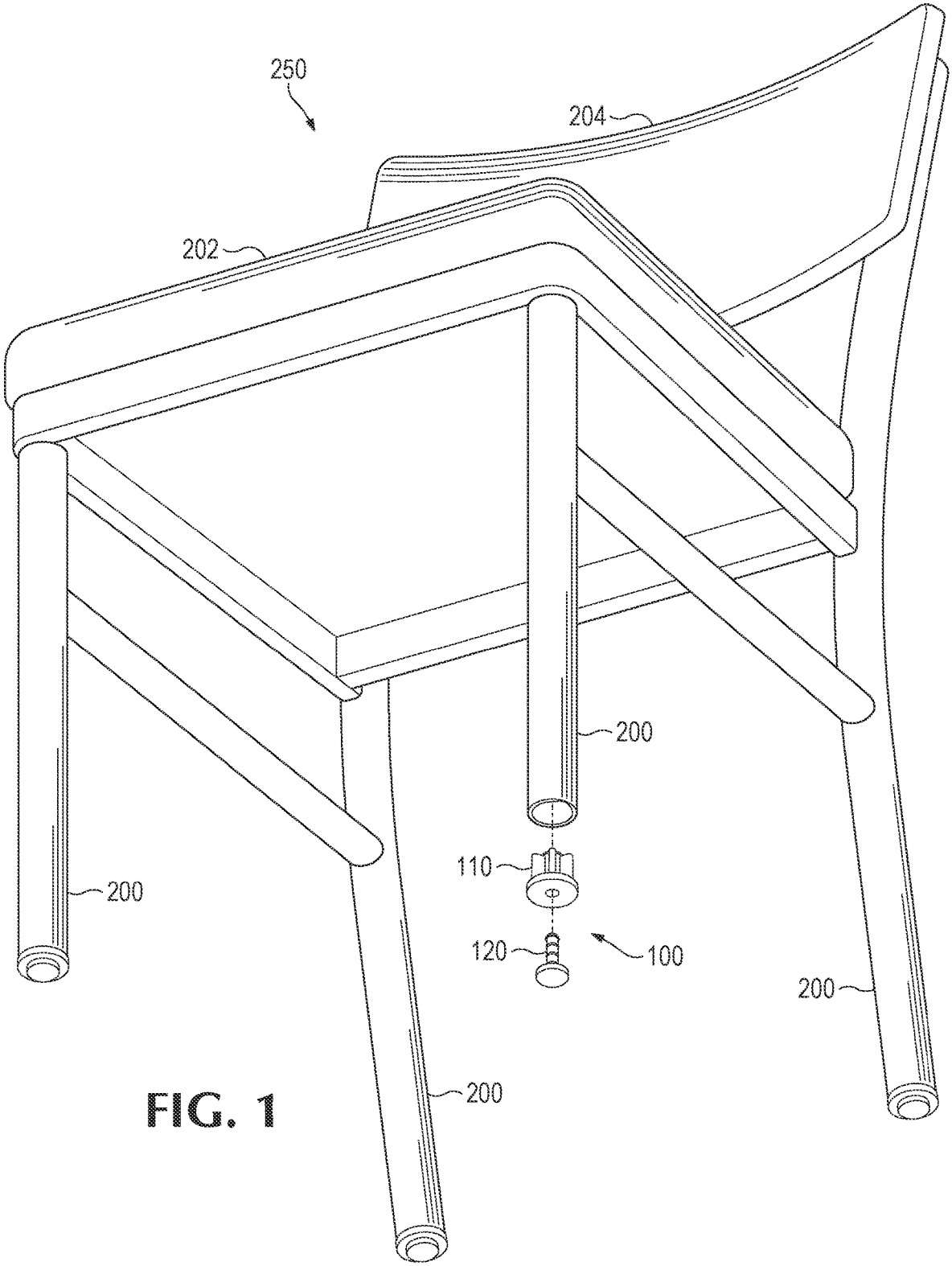
FIG. 1 is an isometric view of an example of a furniture item having a furniture glide of the present disclosure.
Figure 2:
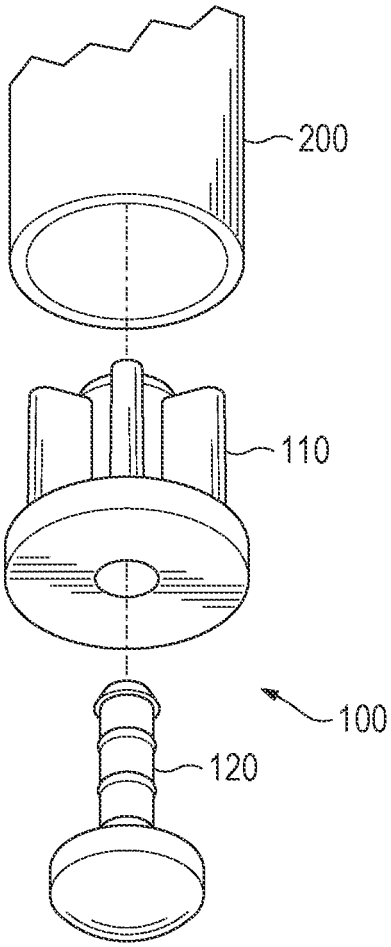
FIG. 2 is a partial view of the furniture item and furniture glide of FIG. 1, showing an exploded view of the furniture glide.
Figure 3:
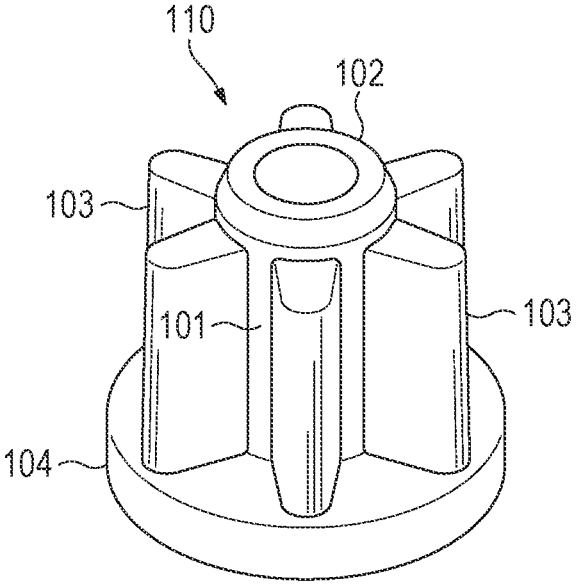
FIG. 3 is an isometric view of an example of a dampener member of the furniture glide of FIGS. 1-2.

Referring to FIGS. 1-6, an illustrative example of a removable furniture glide 100 is shown, which is used to provide noise reduction and prevent unwanted vibration or damage to surface floors and furniture. In some embodiments, the furniture glide 100 includes a floor surface contact member or contact member 120 and a dampener isolator or dampener member 110. The surface contact member 120 may be attached to the dampener isolator 110 in a fashion where the surface contact member 120 is selectively inserted into the dampener isolator 110, and the dampener isolator is further inserted or attached to furniture leg 200 of a furniture item 250. In the example shown in FIG. 1, furniture item 250 also includes a base 202 and a back support 204.

For ease of insertion into the leg 200, the dampener isolator 110 has an end portion or inserting rim 102 with smaller dimensions than that of the openings of the furniture leg 200. The end portion may be any suitable shape(s), such as frustoconical, to facilitate insertion. The opening of the furniture leg may be tubular or rectangular in shape, as shown in the instant embodiment. To facilitate prolonged attachment after insertion, the shape and dimensions of the dampener isolator 110 will largely match that of the furniture leg 200.

In the example shown in FIGS. 1-6, dampener isolator 110 includes ribs or ribbed members 103 protruding or extending from a shaft or elongate portion 101 along the surface of the dampener isolator 110, to provide for better grip of the glide and increased friction between the dampener isolator 110 and the furniture leg 200. The ribbed members also allow for minimized contact with the furniture leg, thus minimizing energy transferred between the glide assembly and the leg. In other words, deepened isolation ribbed members 103 minimize contact with the furniture leg (such as the leg tubing), which minimizes energy transfer between floor surface contact member 120 and furniture leg 200. The ribbed members 103 may serve as guiding pathways of insertion when attaching the member to the leg. The ribbed members 103 may also reduce damage and wear between the dampener isolator and the furniture leg over time. In some embodiments, multiple ribbed members may be spaced equally in a radial fashion.

In addition, the dampener isolator includes a base portion or flange 104 located on the opposing end of the inserting rim 102, to prevent the dampener isolator from being inserted too inward into the furniture leg 200 to the point that the user cannot easily retrieve the dampener isolator from the leg. In other words, the width of flange 104 is greater than the total width of elongate portion 101 and ribbed members 103. The dimensions of the flange 104 may largely correspond to the dimensions of the furniture leg 200, so that the dampener isolator 110 looks like it forms part of the furniture leg 200 when inserted, and does not create any unwanted aesthetic intrusion on a viewer or user. Flange 104 is planar or flat but may, in other embodiments, be any suitable shape(s).

Floor surface contact member 120 is inserted into dampener isolator 110, such as after dampener isolator 110 is inserted into recess 210 of furniture leg 200. The floor surface contact member 120 may have a shaft or elongate portion 126 having an insertable end 121 which fits into the end of the dampener isolator 110 that includes the flange 104. The insertable end may include any suitable shape(s), such as frustoconical. In some embodiments, the floor surface contact member 120 may have ribs or protrusions 122 protruding or extending from elongate portion 126. The ribs or protrusions 122 may be placed longitudinally perpendicular or longitudinal to the direction of insertion into the dampener isolator 110. Ribs 122 may also be described as "annular or orbiting rings." The ribs or protrusions serve a critical function by greatly reducing energy transfer or the transfer of vibration between the floor surface contact member 120 and the floor surface. Aside from the reduction of vibration, the ribs also increase the friction between the floor surface contact member 120 and dampener isolator 110 and prevent the two components from becoming easily detached. The ribs or protrusions are flexible in shape, and may be formed in shapes such as an unbroken ring, individual protrusions, or continuous linear shapes, so long as the ribs or protrusions do not lose their ability to effectively reduce vibration.

Similar to the dampener isolator 110, the floor surface contact member 120 includes a base portion or surface flange 123 on the opposing end of the insertable end 121, so as to prevent the floor surface contact member from being subsumed in the dampener isolator when impressed. The surface flange has a cylinder shape with an end portion 127 that is spherical cap or spherical dome shaped (best shown in FIGS. 5-6), so as to minimize rubbing and contact with the floor, minimize damage to the floor, as well as reduce vibration and sound further, together with the dampener isolator 110. Compared to a circle with edges, the spherical dome shape has a particular advantage as it allows the furniture item to be maneuvered at a greater angle, i.e., a wider range of contact, as there are no corners to catch on in a spherical dome. In other words, the spherical dome shape allows the furniture glide to glide or move over floor inconsistencies in all direction while also reducing floor lowering vibration. In one example, end portion 127 has a diameter of 0.750 inches with a radius of curvature of 1.5 inches. In some other embodiments, the invention may have different dimensions and may be applied to other types of furniture legs.

Figure 4:
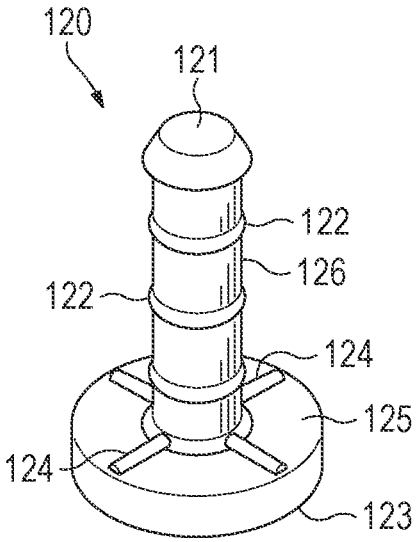
FIG. 4 is an isometric view of the contact member of the furniture glide of FIGS. 1-2.
Figure 5:
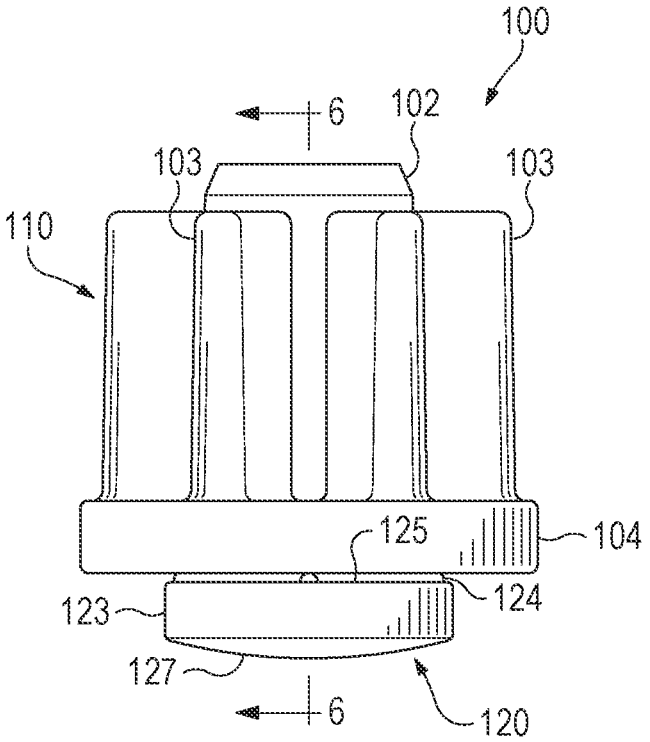
FIG. 5 is a side view of the contact member received in the dampener member of the furniture glide of FIGS. 1-2.
Figure 6:
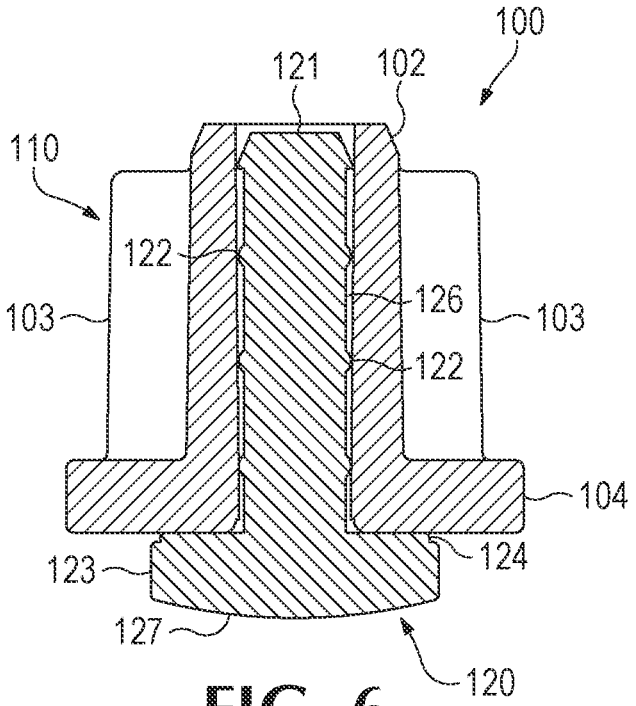
FIG. 6 is a sectional view of the contact member received in the dampener members of the furniture glide of FIGS. 1-2 taken along lines 6-6 in FIG. 5.

As shown in FIGS. 4-6, in some embodiments, the underside 125 of the surface flange 123 may have additional ribs or protrusions 124. The ribs may be evenly and radially aligned along the underside 125, and may be in any shape, such as rings, broken dots or linear. Together with the aforementioned ribs or protrusions 122, the ribs or protrusions 124 on the underside further aid in the reduction of contact transfer or energy transfer and vibration. Notably, when the floor surface contact member 120 is assembled with the dampener isolator 110, the ribs 122, 124, and the insertable end 121 each serve as individual contact points for the components, allowing for control of the overall vibration and sound reduction qualities. Specifically, the insertable end 121 controls the dimensions of the gap when inserted into the dampener isolator 100. In some embodiments, where the ribs 122 are in the shape of a ring, the width of the ring may also be a factor in increasing control over the contact points. Further, in a preferred embodiment where the ribs 124 are radial linear arms, the arms serve to push back against the load from the dampener isolator and chair. In some embodiments, the width of the radial ribs 124 can be adjusted to take on a larger load from the chair or furniture item.

In some embodiments, the dampener isolator 110 may be made from material with ideal noise and shock absorption properties, such as elastane, polyurethane or rubber, or some other type of resilient plastic. The floor surface contact member 120 may be made from materials that are durable so that the member does not easily lose its integrity with prolonged use and contact, but also does not damage the floor surface upon movement, such as glass-filled nylon. A great benefit of using the floor surface contact member 120 and a dampener isolator 110 to form the furniture glide is that this ensures that the various components are flexible and interchangeable. Further, the assembly allows for the two components to be constructed from different materials, achieving maximum noise and vibration reduction, as this ensures that the durability of the dampener isolator 110 is not sacrificed for the noise and vibration reduction properties of the floor surface contact member, given that the dampener isolator 110 is in direct contact with the furniture leg 200 and bears the main brunt of the weight of furniture item 250. The interchangeability of the components allows for the components to be easily switched out, in the event the components experiences wear and tear, or is simply misplaced or lost. Although the furniture glide of the present disclosure is described to be selectively attachable (and detachable) to chairs, the glides may be additionally, or alternatively selectively attachable (and detachable) to other types of furniture or cabinetry.

It will be appreciated that the invention is not restricted to the particular embodiment that has been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. A furniture glide, comprising:

(a) a dampener member including:

a first planar base portion, a first elongate portion that extends from the first planar base portion, the first planar base portion and first elongate portion having a common central hole with a first axis, wherein the first planar base portion has a first width measured perpendicular to the first axis, and a plurality of spaced first ribs that extend from the first elongate portion perpendicular to the first axis, the first elongate portion and the plurality of spaced first ribs being sized for insertion into a recess of a furniture leg; and (b) a contact member including:

a second base portion, a second elongate portion that extends from the second base portion and that defines a second longitudinal axis, wherein the second base portion has a second width measured perpendicular to the second longitudinal axis, the second width being less than the first width, and a plurality of spaced second ribs that extend from the second elongate portion perpendicular to the second longitudinal axis, the second elongate portion and the plurality of spaced second ribs being received in the common central hole.

2. The furniture glide of claim 1, wherein the first elongate portion includes a length, and wherein each of the plurality of spaced first ribs spans at least a substantial portion of the length.

3. The furniture glide of claim 1, wherein the first elongate portion includes an end portion spaced from the first planar base portion, and wherein the end portion is frustoconical.

4. The furniture glide of claim 1, wherein total width of the first elongate portion and the plurality of spaced first ribs is less than width of the first planar base portion.

5. The furniture glide of claim 1, wherein the first elongate portion is cylindrical shaped.

6. The furniture glide of claim 1, wherein the second elongate portion is cylindrical having a perimeter.

7. The furniture glide of claim 6, wherein each of the plurality of spaced second ribs spans the perimeter of the second elongate portion.

8. The furniture glide of claim 1, further comprising a plurality of spaced third ribs that extend from the second base portion parallel to the second longitudinal axis.

9. The furniture glide of claim 8, wherein the second base portion has a perimeter and each of the plurality of spaced third ribs spans a substantial portion between the perimeter and the second elongate portion.

10. The furniture glide of claim 1, wherein the second elongate portion includes an end portion spaced from the second base portion, and wherein the end portion is frustoconical.

11. The furniture glid of claim 1, wherein the second base portion includes an end portion that is spherical dome-shaped.

12. A furniture item, comprising:

a base;

at least one leg attached to the base, the at least one leg having an end portion that is spaced from the base and that includes a recess; and the furniture glide of claim 1 received in the recess.

13. The furniture item of claim 12, further comprising a back support attached to the base.

14. A furniture glide, comprising:

(a) a dampener member including:

a first planar base portion, a first elongate portion that extends from the first planar base portion, the first elongate portion being cylindrical shaped, the first planar base portion and first elongate portion having a common central hole with a first axis, wherein the first planar base portion has a first width measured perpendicular to the first axis, and a plurality of spaced first ribs that extend from the first elongate portion perpendicular to the first axis, the first elongate portion and the plurality of spaced first ribs being sized for insertion into a recess of a furniture leg, the first elongate portion having a first length, and each of the plurality of spaced first ribs extending along at least a substantial portion of the first length, and a total width of the first elongate portion and the plurality of spaced first ribs being less than width of the first planar base portion; and (b) a contact member including:

a second base portion having an end portion that is spherical dome-shaped, a second elongate portion that extends from the second base portion and that defines a second longitudinal axis, the second elongate portion being cylindrical shaped, wherein the second base portion has a second width measured perpendicular to the second longitudinal axis, the second width being less than the first width, and a plurality of spaced second ribs that extend from the second elongate portion perpendicular to the second longitudinal axis, the second elongate portion and the plurality of spaced second ribs being received in the common central hole.

15. The furniture glide of claim 14, further comprising a plurality of spaced third ribs that extend from the second base portion parallel to the second longitudinal axis, wherein the second base portion has a perimeter and each of the plurality of spaced third ribs extends along a substantial portion between the perimeter and the second elongate portion.

16. A furniture item, comprising:

a base;

at least one leg attached to the base, the at least one leg having an end portion that is spaced from the base and that includes a recess; and the furniture glide of claim 14 received in the recess.

17. The furniture item of claim 16, further comprising a back support attached to the base.

18. The furniture item of claim 1, wherein the first planar base portion has a cylindrical shape.

19. The furniture item of claim 1, wherein the first planar base portion includes opposed top and bottom surfaces, the first elongate portion extending from the top surface, and the bottom surface being flat and being spaced from the first elongate portion relative to the top surface.

20. The furniture item of claim 14, wherein the first planar base portion includes opposed top and bottom surfaces, the first elongate portion extending from the top surface, and the bottom surface being flat and being spaced from the first elongate portion relative to the top surface.

* * * * *